US008474199B2

(12) United States Patent
Oh

(10) Patent No.: US 8,474,199 B2
(45) Date of Patent: Jul. 2, 2013

(54) SPRINKLER MOUNTING DEVICE

(75) Inventor: Seung-il Oh, Seoul (KR)

(73) Assignee: Kofulso Co., Ltd., Incheon-si (KR)

( * ) Notice: Subject to any disclaimer, the term of this patent is extended or adjusted under 35 U.S.C. 154(b) by 565 days.

(21) Appl. No.: 12/654,662

(22) Filed: Dec. 29, 2009

(65) Prior Publication Data

US 2011/0154755 A1 Jun. 30, 2011

(51) Int. Cl.
*E04C 2/52* (2006.01)
*E04B 2/00* (2006.01)
*B42F 13/00* (2006.01)

(52) U.S. Cl.
USPC ..... 52/220.6; 52/506.07; 248/343

(58) Field of Classification Search
USPC ..... 248/49, 58, 62, 65, 72, 73, 74.1, 248/74.2, 74.3, 74.4, 74.5, 75, 317, 343, 248/534; 52/220.6, 506.07, 712, 715; 169/16, 169/37, 41
See application file for complete search history.

(56) References Cited

U.S. PATENT DOCUMENTS

| | | | | |
|---|---|---|---|---|
| 3,608,857 | A | 9/1971 | Hibbeler | 248/317 |
| 3,612,461 | A | 10/1971 | Brown | 248/317 |
| 3,652,780 | A | 3/1972 | Wilson | 248/72 |
| 3,874,035 | A | 4/1975 | Schuplin | 248/72 |
| 4,135,692 | A | 1/1979 | Ferguson | 248/317 |
| 4,717,099 | A | 1/1988 | Hubbard | 248/57 |
| 4,723,749 | A | 2/1988 | Carraro et al. | 248/317 |
| 5,595,363 | A | 1/1997 | DeLeebeeck | 248/72 |
| 5,667,181 | A | 9/1997 | van Leeuwen et al. | 248/343 |
| 6,260,810 | B1 * | 7/2001 | Choi | 248/65 |
| 6,345,800 | B1 | 2/2002 | Herst et al. | 248/342 |
| 6,554,231 | B2 * | 4/2003 | Choi | 248/65 |
| 6,811,130 | B1 * | 11/2004 | Oh | 248/343 |
| 7,264,214 | B2 * | 9/2007 | Oh | 248/342 |
| 7,427,051 | B2 | 9/2008 | Oh | 248/73 |
| 7,455,268 | B2 * | 11/2008 | Heath | 248/74.1 |
| 7,506,845 | B2 * | 3/2009 | Oh | 248/73 |
| 7,735,787 | B2 * | 6/2010 | Kafenshtok et al. | 248/75 |
| 7,784,746 | B2 * | 8/2010 | Kafenshtok et al. | 248/75 |
| 7,845,599 | B2 * | 12/2010 | Jackson | 248/73 |
| 8,109,482 | B2 * | 2/2012 | Oh | 248/342 |
| 2008/0099640 | A1 * | 5/2008 | Kafenshtok et al. | 248/200.1 |
| 2011/0154755 | A1 * | 6/2011 | Oh | 52/220.8 |

* cited by examiner

*Primary Examiner* — Andrew Triggs

(74) *Attorney, Agent, or Firm* — Jacobson Holman PLLC

(57) ABSTRACT

A sprinkler mounting device, in which an open-type mounting bracket for mounting a reducer having a head is temporarily joined to a support bar, thereby preventing a separation of the mounting bracket from the support bar during work.

5 Claims, 8 Drawing Sheets

SPRINKLER MOUNTING DEVICE

BACKGROUND OF THE INVENTION

1. Field of the Invention

The present invention relates to a sprinkler mounting device, and more particularly, to a sprinkler mounting device that can prevent a separation of a mounting bracket from a support bar during mounting work of a reducer.

2. Background Art

In general, as shown in FIGS. 1 and 2, a sprinkler mounting device includes: a pair of T-shaped frames 1 mounted on a ceiling parallel with each other at a predetermined interval; a pair of support units 2 perpendicularly standing and joined to the T-shaped frames 1; a support bar 3 disposed on upper portions of the support units 2 in such a way as to cross the T-shaped frames 1; and a mounting bracket 4 mounted on the support bar 3 in a laterally movable manner, so that a reducer 5 is joined thereto.

Conventionally, the sprinkler mounting device is divided into two types: one being a separate type that the support bar 3 is separated from the support units 2; and the other being an integral type that bent portions, which serve the same role as the support units 2, are formed at both end portions of the support bar 3. Moreover, the mounting bracket 4 is divided into a closed type that the reducer 5 is perpendicularly and downwardly fit thereto and an open type that the reducer 5 fit the mounting bracket 4 from the front.

However, because a diameter of a head 6 is larger than that of the reducer 5, in case that the closed-type mounting bracket 4 is used, a user has to perform all operations to mount the head 6 to the reducer 5 in a state where he or she stands on a foothold after the reducer 5 is mounted on the mounting bracket 4.

In order to lessen discomfort during those operations, the open-type mounting bracket 4 for fitting the reducer 5 with the head 6 from the front thereto is typically used, but has a problem in that the mounting bracket 4 is separated from the support bar 3 during the operation to join the reducer 5 to the mounting bracket 4 in the state where the user stands on the foothold.

That is, as shown in FIG. 1, in case that the support units 2 are disposed integrally with the support bar 3 and the closed-type mounting bracket 4 is joined to the support bar 3, the mounting device has several advantages in that the mounting bracket 4 is not separated from the support bar 3 during the operation to mount the reducer 5 to the mounting bracket 4 in the state where the user stands on the foothold, and in that it is easy and convenient to use and handle due to the integrated structure of the components.

However, in this case, the mounting device that the support units 2 are disposed integrally with the support bar 3 and the closed-type mounting bracket 4 is joined to the support bar 3 has several problems in that it is inconvenient since the user has to perform all operations to mount the head 6 to the reducer 5 in a posture to look upward on the foothold after mounting the reducer 5 to the mounting bracket 4, in that a standardized rectangular bar cannot be used as the support bar 3, and in that it has some difficulty in manufacturing since the support units 2 must be bent and formed at both sides of the support bar 3 in a state where the mounting bracket 4 is mounted on the support bar 3.

As shown in FIG. 2, in case that the support bar 3 and the support units 2 are manufactured separately from each other and the open-type mounting bracket 4 is joined to the support bar 3, the mounting device has an advantage in that the user can conveniently work since the reducer 5 with the head 6 joined thereto is mounted to the mounting bracket 4.

However, in this case, the mounting device that the support bar 3 and the support units 2 are manufactured separately from each other and the open-type mounting bracket 4 is joined to the support bar 3 has several problems in that the mounting bracket 4 may be separated from the support bar 3 during the mounting work, and in that it is difficult to manage the components individually.

SUMMARY OF THE INVENTION

Accordingly, the present invention has been made to solve the above-mentioned problems occurring in the prior arts, and it is an object of the present invention to provide a sprinkler mounting device, in which an open-type mounting bracket adapted to mount a reducer having a head includes a means to be temporarily joined to a support bar, thereby preventing a separation of the mounting bracket from the support bar during work.

To accomplish the above object, according to the present invention, there is provided a sprinkler mounting device comprising: a pair of T-shaped frames mounted on a ceiling parallel with each other at a predetermined interval; a pair of support units perpendicularly standing and joined to the T-shaped frames; a support bar disposed on upper portions of the support units in such a way as to cross the T-shaped frames; and a mounting bracket including upper and lower plates, each having an open portion and a mounting space portion communicatively formed with the open portion, so that a reducer can be inserted thereinto from a side, a retaining jaw portion formed between the open portion and the mounting space portion, an insertion portion formed by a " ⊏ "-shaped plate for positioning the upper and lower plates parallel, the insertion portion having a height corresponding to that of the support bar, cut portions formed at both sides of the rear part of the lower plate, an elastically bent portion formed in such a way that a portion formed by the cut portion is bent to have front and rear inclined faces, and a tightening screw fastened to a screw hole formed on a vertical face located on the opposite side of the insertion portion.

As described above, the mounting bracket is the open-type mounting bracket, which can be easily mounted to the support bar through the open portion without regard to types (the integral type or the separate type) of the support units and the support bar. When the user mounts the reducer to the mounting bracket in a posture that the user stands on the foothold, the position of the mounting bracket is restricted by the elastically bent portion and the vertical face to thereby prevent the separation of the mounting bracket from the support bar, whereby the mounting work of the sprinkler can be achieved conveniently and rapidly.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Reference will be now made in detail to the preferred embodiment of the present invention with reference to the attached drawings.

Figure 1:
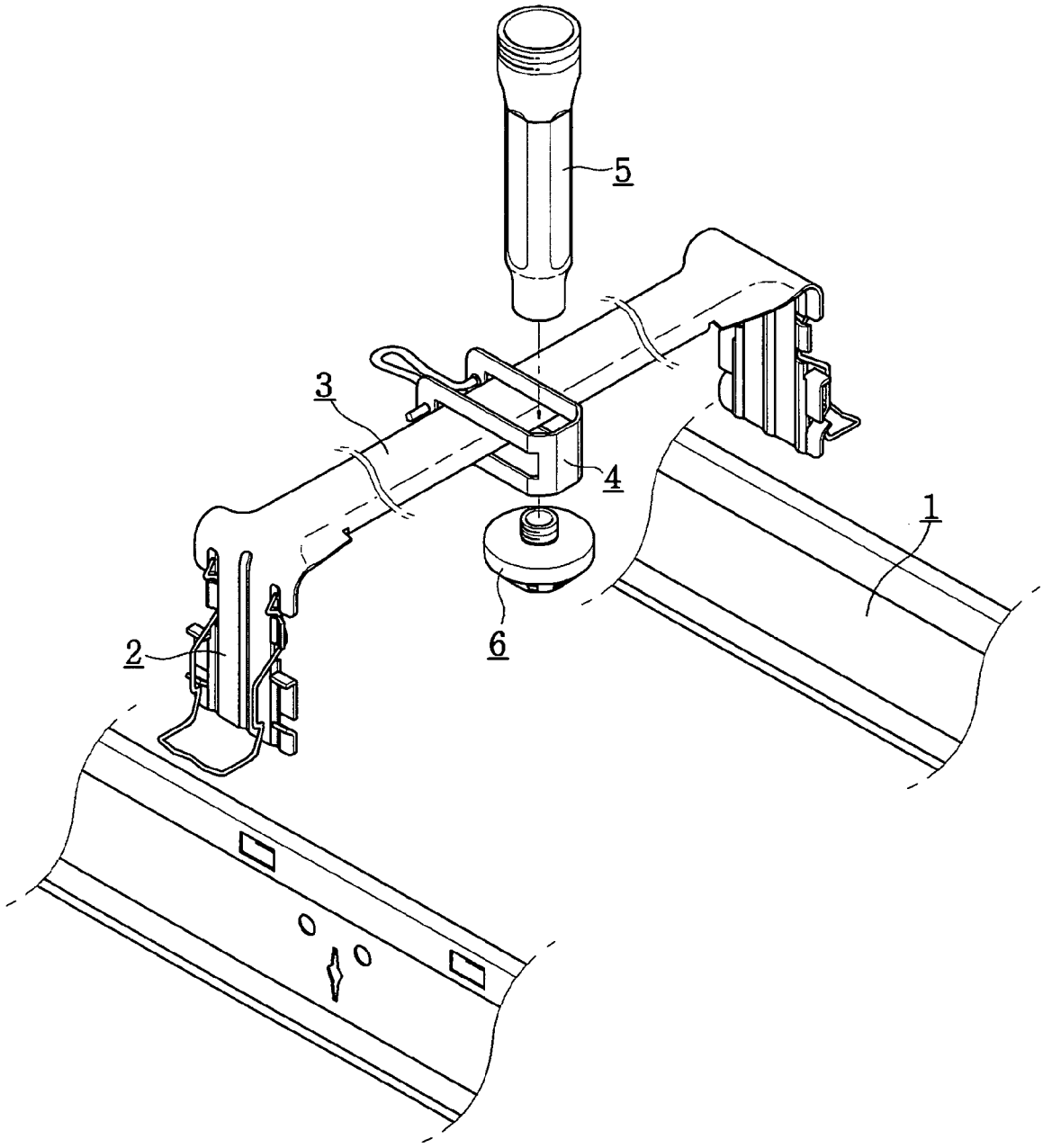
FIG. 1 PRIOR ART
FIG. 1 is a perspective view of a conventional sprinkler mounting device that a support bar and support units are formed integrally.
Figure 2:
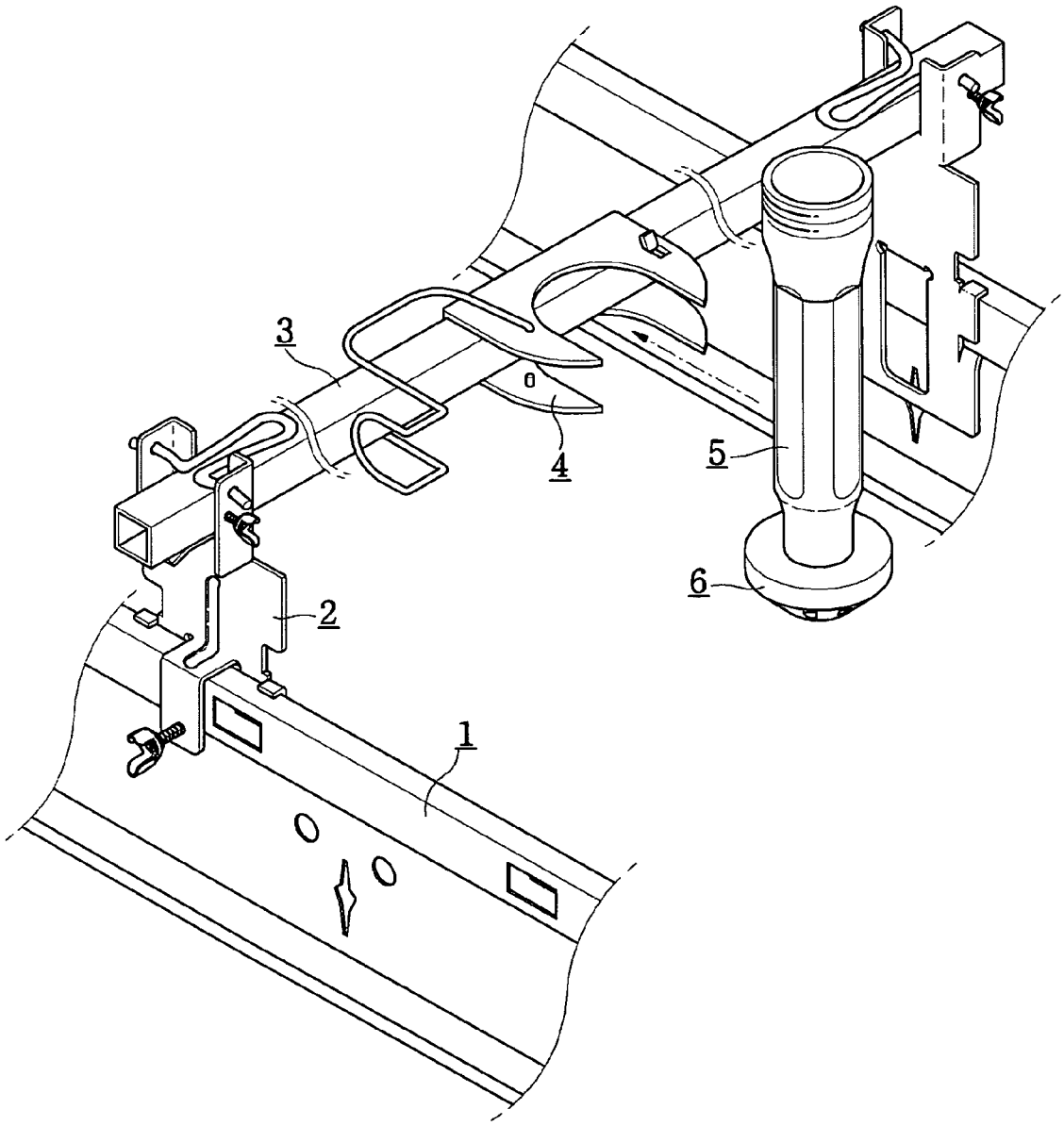
FIG. 2 PRIOR ART
FIG. 2 is a perspective view of another conventional sprinkler mounting device that a support bar and support units are formed separately.
Figure 3:
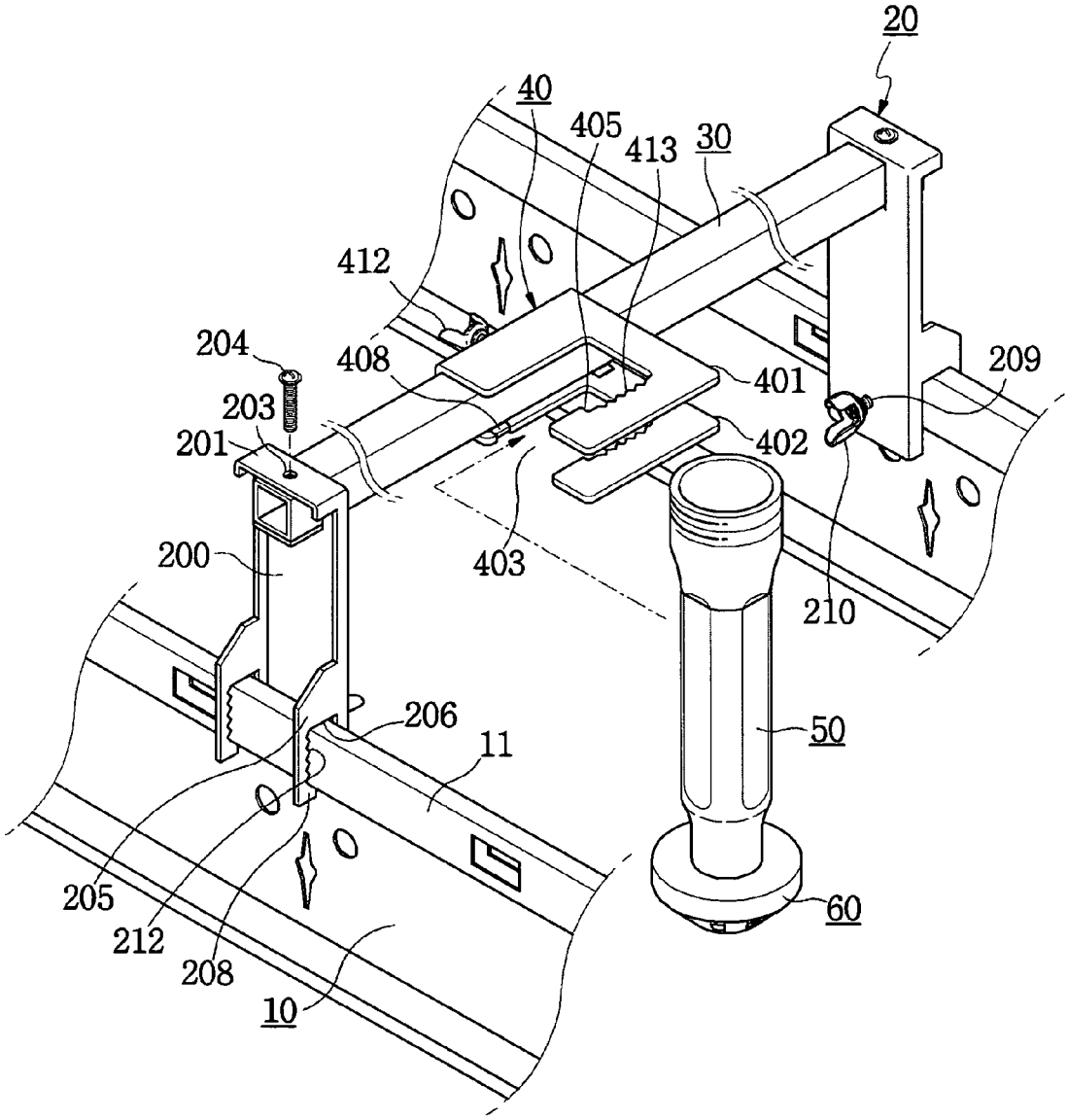
FIG. 3 is a perspective view of a sprinkler mounting device according to the present invention.

As shown in FIG. 3, a sprinkler mounting device according to the present invention includes a pair of T-shaped frames 10, support units 20, a support bar 30, and a mounting bracket 40.

The T-shaped frames is mounted on a ceiling parallel with each other at a predetermined interval, and each includes a thick portion 11 on which an iron plate is overlapped with the T-shaped frame 10 in such a way as to be joined with the support unit 20. A space portion 12 is formed between the overlapped iron plates for forming the thick portion 11.

Figure 4:
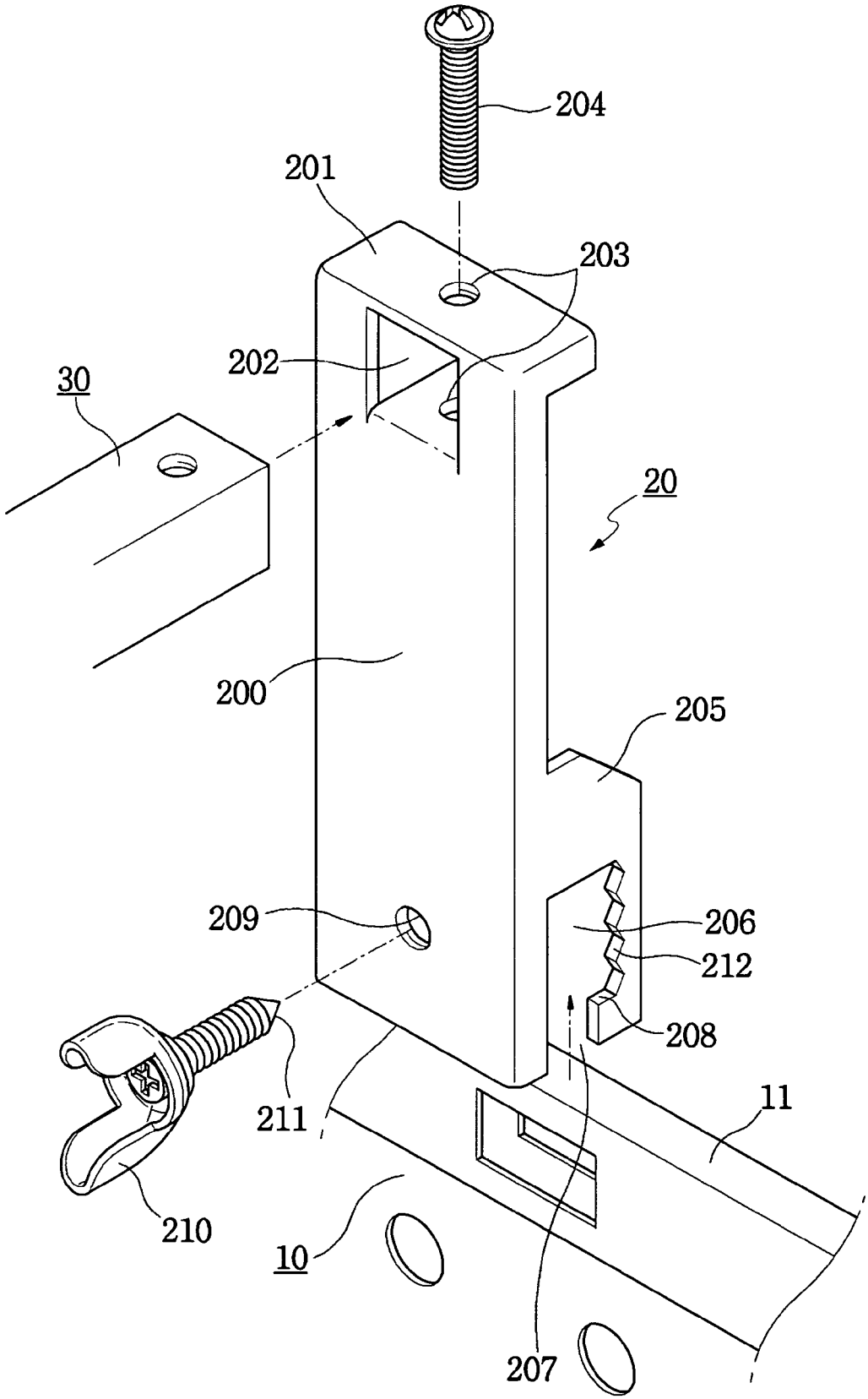
FIG. 4 is a perspective view of support units according to the present invention.
Figure 5:
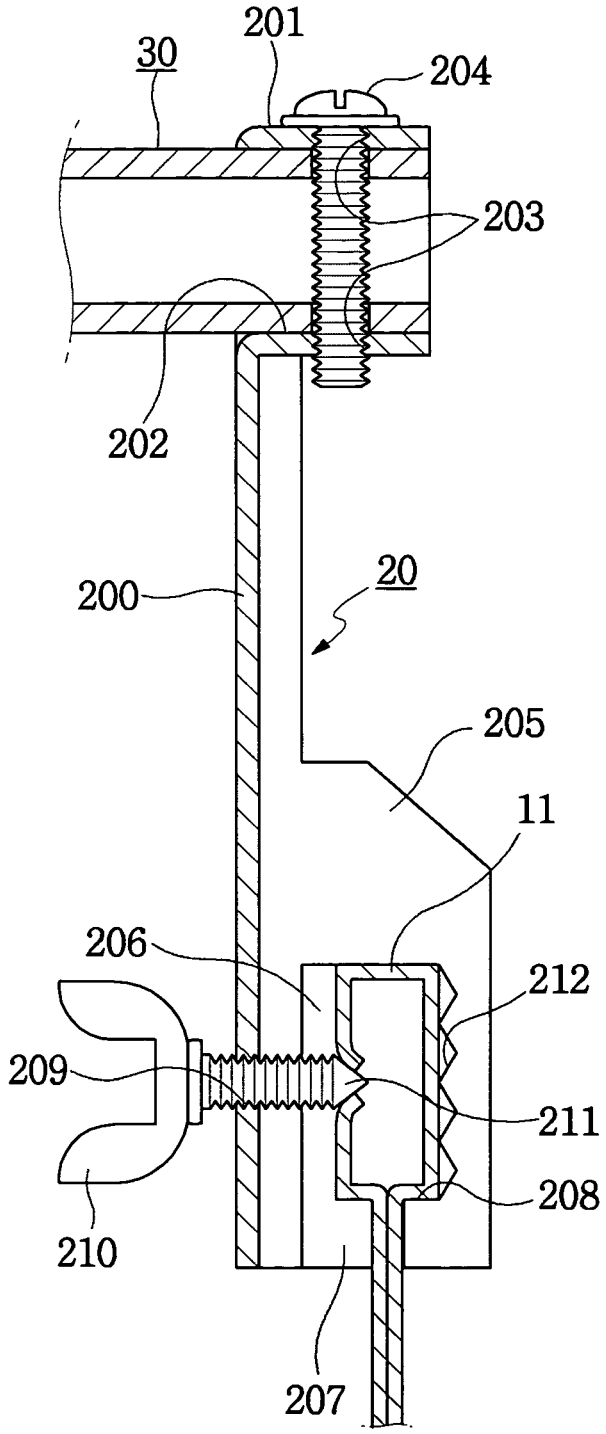
FIG. 5 is a sectional view taken along the line of X-X of FIG. 3.

As shown in FIGS. 4 and 5, each of the support units 20 perpendicularly stands on the thick portion 11 of the T-shaped frame 10, and includes: a support body 200; an one-sidedly bent portion 201 formed on an upper portion of the support body 200; a coupling hole 202 formed beneath the bent portion 201 for inserting one side of the support bar 30 thereinto; a fastening screw 204 fastened to the support bar 30 through a through hole 203 of the bent portion 201; projecting portions 205 formed at both sides of a lower portion of the support body 200; coupling space portions 206 formed in the projecting portions 205 for fitting the thick portion 11 of the T-shaped frame 10 thereto; open passageways 207 formed beneath the coupling space portions 206 for passing the thick portion 11; support projecting jaws 208 formed inwardly from the open passageways 207 to clamp a lower end of the thick portion 11; a screw hole 209 formed on the lower portion f the support body 200; and a fixing screw 210 fastened to the support body 200 through the screw hole 209 and having a tip portion 211 penetrating a vertical portion of the thick portion 11. Saw-toothed projecting portions 212 are respectively formed on the coupling space portions 206.

The support bar 30 is a standardized pipe with a rectangular section, which is cut according to an interval of the T-shaped frames 10 mounted on the ceiling in parallel.

Figure 6:
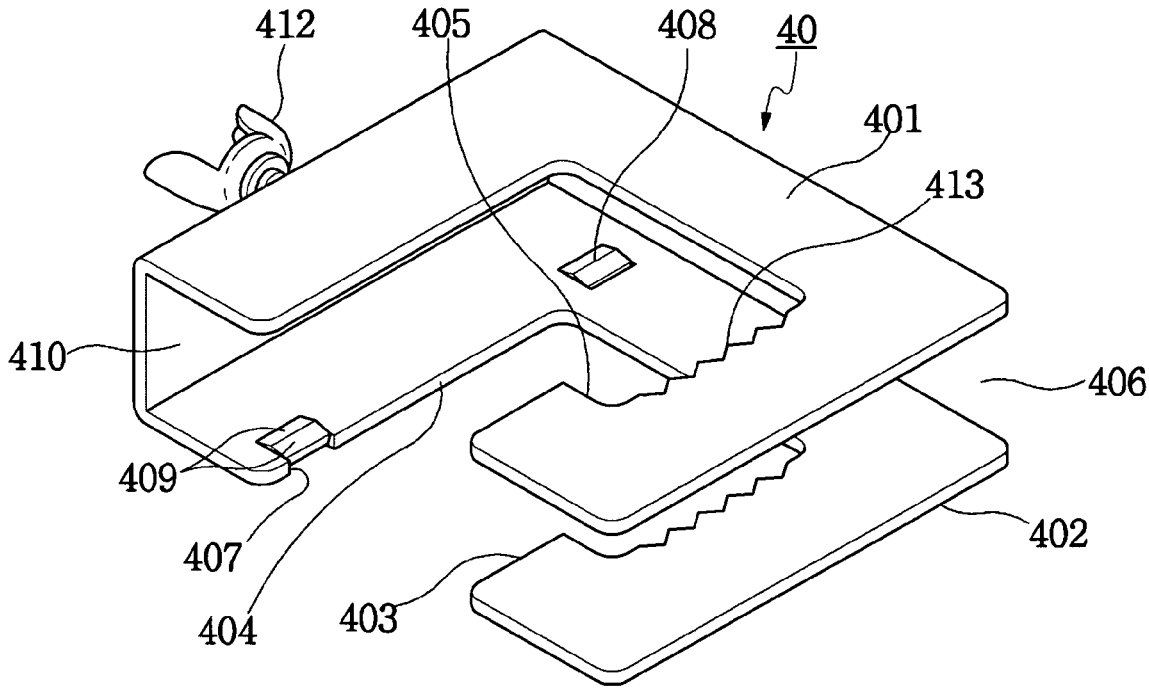
FIG. 6 is a perspective view of a mounting bracket according to the present invention.

As shown in FIG. 6, the mounting bracket 40 includes: upper and lower plates 401 and 402, each having an open portion 403 and a mounting space portion 404 communicatively formed with the open portion 403, so that the reducer 50 can be inserted into the mounting bracket 40 from a side; a retaining jaw portion 405 formed between the open portion 403 and the mounting space portion 404; an insertion portion 406 formed by a "ㄷ"-shaped plate for positioning the upper and lower plates 401 and 402 parallel, the insertion portion 406 having a height corresponding to that of the support bar 30; cut portions 407 formed at both sides of the rear part of the lower plate 402; an elastically bent portion 408 formed in such a way that a portion formed by the cut portion 407 is bent to have front and rear inclined faces 409; and a tightening screw 412 fastened to a screw hole 411 formed on a vertical face 410 located on the opposite side of the insertion portion 406. The mounting bracket 40 further includes a saw-toothed protruding portion 413 formed in front of the mounting space portion 404.

In the sprinkler mounting device according to the present invention, as shown in FIG. 5, the support units 20 are joined with the T-shaped frames 10 in such a way that the tip portions 211 penetrate sides of the thick portions 11 by tightening the fastening screws 210 in a state where the thick portions 11 of the T-shaped frames 10, which are mounted on the ceiling parallel, are positioned in the coupling space portions 206 through the open passageways 207.

When the fixing screw 210 is tightened, the thick portion 11 is in close contact with the saw-toothed projecting portion 212, and the support projecting jaws 208 are caught to the lower end of the thick portion 11 to thereby prevent the support unit 20 from being separated through the open passageway 207.

Both sides of the support bar 30 with the rectangular section are inserted into the coupling holes 202 of the support units 20, and then, the fastening screw 204 penetrates and fixes the support bar 30 through the coupling hole 202 of the bent portion 201.

In order to mount the mounting bracket 40 to the support bar 30, the insertion portion 406 is fit to the support bar 30 from the rear.

Figure 7:
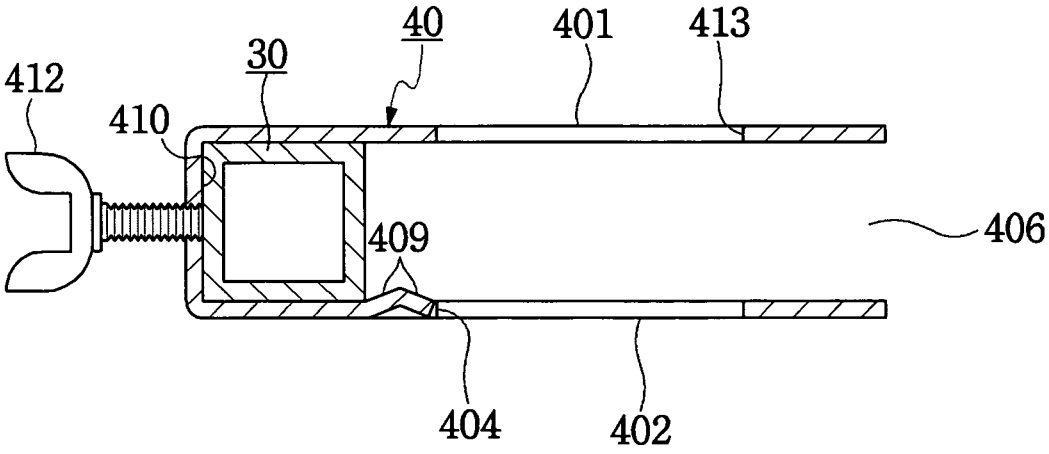
FIG. 7 is a sectional view showing a state where the mounting bracket is joined to a support bar according to the present invention.

In this instance, as shown in FIG. 7, the elastically bent portion 408 serves to prevent a separation of the support bar 30 between the upper and lower plates 401 and 402 in such a way as to be returned to an original state by its restoring force when the support bar 30 touches the vertical face 410 after the inclined face 409 is pressed down by the support bar 30.

Figure 8:
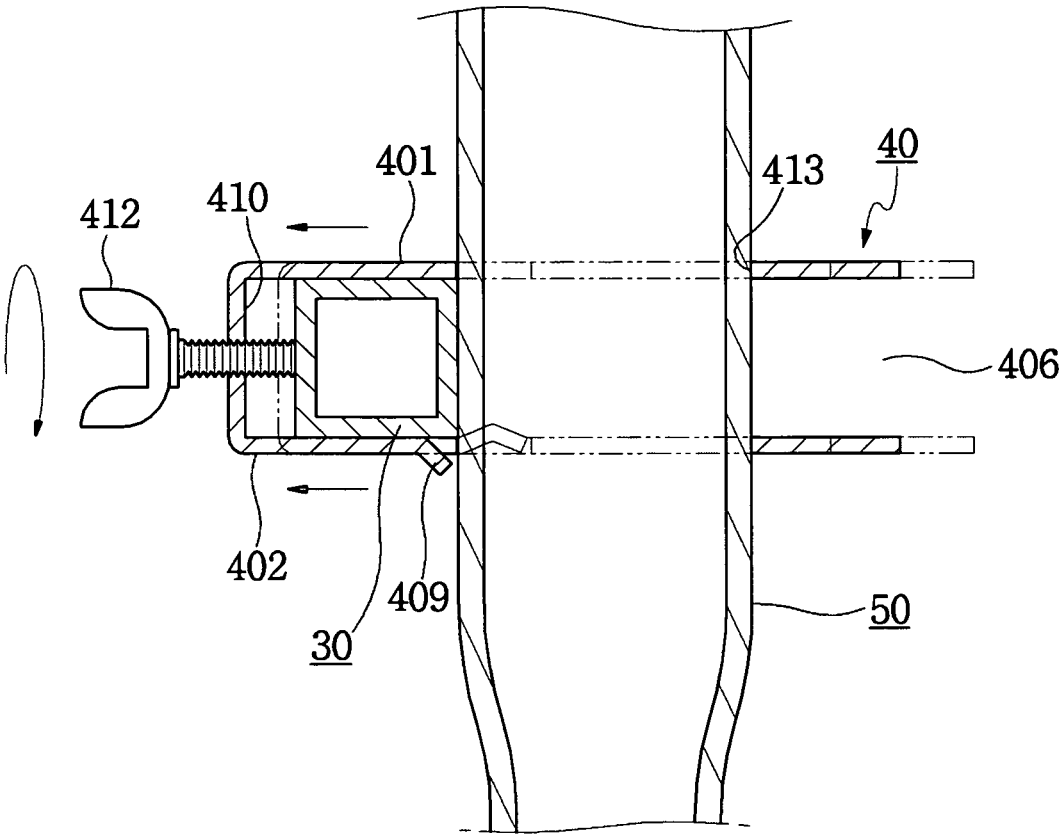
FIG. 8 is a sectional view showing a state where a reducer is mounted on the mounting bracket according to the present invention.

In the above state, when the reducer 50 with the head 60 is pushed from the open portion 403 toward the mounting space portion 404 and the tightening screw 412 is tightened, as shown in FIG. 8, the mounting bracket 40 is pulled backwardly, so that the saw-toothed protruding portion 413 and the support bar 30 clamps the reducer 50, whereby mounting work of the sprinkler is finished.

The elastically bent portion 408 is pressed by the support bar 30 when the mounting bracket 40 is pulled backwardly, and the retaining jaw portion 405 serves to prevent the reducer 50 from being separated through the open portion 403.

As described above, the mounting bracket 40 is the open-type mounting bracket, which can be easily mounted to the support bar 30 without regard to types of the support units 20 and the support bar 30. When the user mounts the reducer 50 to the mounting bracket 40 in a posture that the user stands on the foothold, the position of the mounting bracket 40 is restricted by the elastically bent portion 408 and the vertical face 410 to thereby prevent the separation of the mounting bracket 40 from the support bar 30, whereby the mounting work of the sprinkler can be achieved conveniently and rapidly. Moreover, the sprinkler mounting device according to the present invention can provide the same structural durability as the integral-type device since the T-shaped frames 10 and the support units 20 are joined with each other through the fastening screws 210 and the support units 20 and the support bar 30 are joined with each other through the fastening screws 204.

While the present invention has been described with reference to the particular illustrative embodiment, it is not to be restricted by the embodiment but only by the appended claims. It is to be appreciated that those skilled in the art can change or modify the embodiment without departing from the scope and spirit of the present invention.

What is claimed is:

1. A sprinkler mounting device comprising:

a pair of T-shaped frames mounted on a ceiling parallel with each other at a predetermined interval;

a pair of support units perpendicularly standing and joined to the T-shaped frames;

a support bar disposed on upper portions of the support units in such a way as to cross the T-shaped frames; and a mounting bracket including:

upper and lower plates, each of the upper and lower plates having an open portion facing one of the pair of T-shaped frames, and a mounting space portion communicatively formed with the open portion; so that a reducer can be inserted thereinto from a side and through the open portion into the mounting space portion;

a retaining jaw portion formed between the open portion and the mounting space portion;

an insertion portion formed by a C-shaped plate for positioning the upper and lower plates parallel, the insertion portion having a height corresponding to that of the support bar;

cut portions formed at both sides of a rear part of the lower plate;

an elastically bent portion of the cut portions having front and rear inclined faces; and a tightening screw fastened to a screw hole formed on a vertical face located on an opposite side of the insertion portion for tightening against the support bar and pulling the mounting bracket backward while moving the support bar into engagement with the elastically bent portion of the cut portions.

2. The sprinkler mounting device according to claim 1, wherein each of the support units comprises:

a support body;

an one-sidedly bent portion formed on an upper portion of the support body;

a coupling hole formed beneath the bent portion for inserting one side of the support bar thereinto;

a fastening screw fastened to the support bar through a through hole of the bent portion;

projecting portions formed at both sides of a lower portion of the support body;

coupling space portions formed in the projecting portions for fitting a thick portion of the T-shaped frame thereto;

open passageways formed beneath the coupling space portions for passing the thick portion;

support projecting jaws formed inwardly from the open passageways to clamp a lower end of the thick portion;

a screw hole formed on the lower portion of the support body; and a fixing screw fastened to the support body through the screw hole and having a tip portion penetrating a vertical portion of the thick portion.

3. The sprinkler mounting device according to claim 2, wherein each of the coupling space portions comprises a saw-toothed projecting portion.

4. The sprinkler mounting device according to claim 1, wherein the support bar is a pipe with a rectangular section.

5. The sprinkler mounting device according to claim 1, wherein the mounting bracket further comprises a saw-toothed protruding portion formed in front of the mounting space portion.

* * * * *